United States Patent [19]

Maghon

[11] Patent Number: 5,062,792

[45] Date of Patent: Nov. 5, 1991

[54] HYBRID BURNER FOR A PRE-MIXING OPERATION WITH GAS AND/OR OIL, IN PARTICULAR FOR GAS TURBINE SYSTEMS

[75] Inventor: Helmut Maghon, Mülheim/Ruhr, Fed. Rep. of Germany

[73] Assignee: Siemens Aktiengesellschaft, Munich, Fed. Rep. of Germany

[21] Appl. No.: 425,432

[22] Filed: Oct. 20, 1989

Related U.S. Application Data

[63] Continuation of Ser. No. 148,447, Jan. 26, 1988, abandoned.

[30] Foreign Application Priority Data

Jan. 26, 1987 [DE] Fed. Rep. of Germany ..... 3702181

[51] Int. Cl.[5] ..... F23Q 9/00

[52] U.S. Cl. ..... 431/284; 431/183; 431/185; 60/746; 60/747; 60/748; 239/400; 239/403; 239/405

[58] Field of Search ..... 431/9, 183, 185, 175, 431/278, 284, 283; 60/733, 746, 747, 748; 239/400, 403, 405, 406

[56] References Cited

U.S. PATENT DOCUMENTS

| | | | |
|---|---|---|---|
| 2,773,350 | 12/1956 | Barrett et al. | 60/746 X |
| 2,822,864 | 2/1958 | Black | 431/284 X |
| 3,236,279 | 2/1966 | Beyer | 431/284 |
| 3,542,500 | 12/1970 | Norcross | 431/278 X |
| 3,897,200 | 7/1975 | Childree | 431/285 X |
| 3,958,416 | 5/1976 | Hammond, Jr. | 60/746 X |
| 4,288,980 | 9/1981 | Ernst | 60/746 X |
| 4,544,350 | 10/1985 | Ware, III et al. | 431/285 |
| 4,766,721 | 8/1988 | Iizuka et al. | 60/747 X |

FOREIGN PATENT DOCUMENTS

| | | | |
|---|---|---|---|
| 0193838 | 9/1986 | European Pat. Off. . | |
| 3606625 | 9/1986 | Fed. Rep. of Germany . | |
| 2123945 | 2/1984 | United Kingdom | 431/284 |

*Primary Examiner*—Carl D. Price

*Attorney, Agent, or Firm*—Herbert L. Lerner; Laurence A. Greenberg

[57] ABSTRACT

A burner for operation with gas and/or includes a central pilot burner system selectively operable with gas and/or oil as a diffusion burner or as a separate pre-mixing burner and an annular main burner system surrounding the pilot burner system and carrying a primary air flow. The main burner system includes a multiplicity of first nozzles admixing gas with the primary air flow for pre-mixing operation and second inlet nozzles pre-mixing oil into the primary air flow.

11 Claims, 1 Drawing Sheet

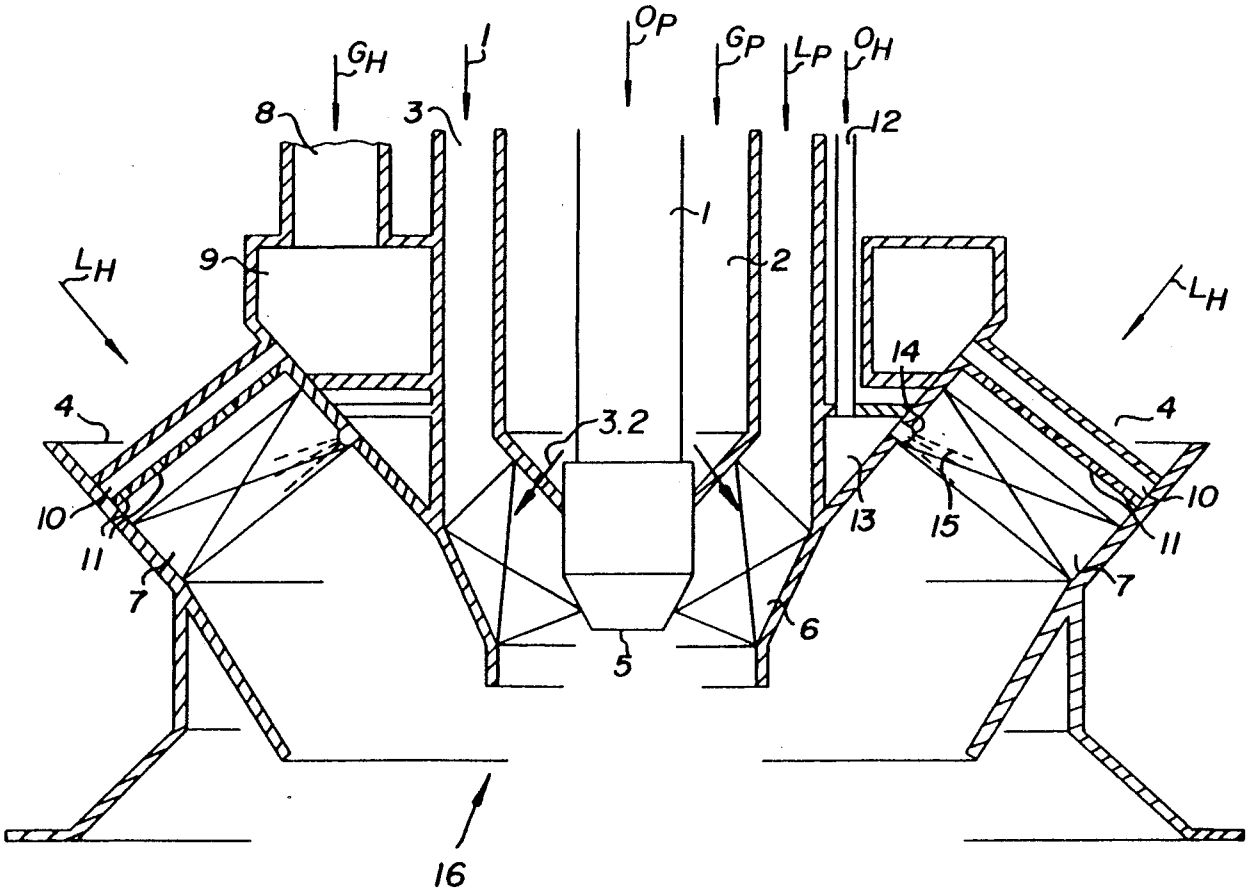
LH
4
10
11
7
15
14
13
12
OH
LP
GP
OP
2
1
6
3.2
5
3
GH
8
9
16

HYBRID BURNER FOR A PRE-MIXING OPERATION WITH GAS AND/OR OIL, IN PARTICULAR FOR GAS TURBINE SYSTEMS

This application is a continuation of application Ser. No. 148,447, filed Jan. 26, 1988, now abandoned.

BACKGROUND OF THE INVENTION

1. Field of the Invention

The invention relates to a burner for operation with gas and/or oil, including a central pilot burner system which can be operated with gas and/or oil as a diffusion burner or as a separate pre-mixing burner, optional additional means for feeding inert substances, and an annular main burner system surrounding the pilot burner system for pre-mixing operation with gas which can be admixed with the primary air flow from a multiplicity of nozzles.

2. Description of the Related Art

Burners of this kind and the applications and possible installations thereof are known from European Patent Application No. 0 193 838, corresponding to U.S. Pat. No. 4,701,124. This publication also describes the structure of such a burner in detail and is hereby expressly incorporated by reference, so that the ensuing description can be restricted to the novel details essential to the invention.

The burner known from the prior art is likewise suitable for operation with gas and/or oil, but it is not possible to perform both alternatives in pre-mixing operation. When a burner according to the prior art is to be operated with oil, the conventional structure operates as a diffusion burner, which has disadvantages in terms of the emissions of toxic substances. The prior art burner configuration has a multiplicity of nozzle tubes in the vicinity of the primary air flow and gas is admixed with the air flow in these nozzle tubes. In principle, this kind of admixture system can also be supplied with oil instead of gas, but in that case, because of the entirely different volumetric flows, the nozzles must be dimensioned quite differently. Hence once a system has been installed, it is only suitable for premixing operation with gas or with oil. Furthermore, the feeding point that is favorable for gas and is located upstream of the swirl vanes, is not particularly well suited for feeding oil and atomizing it finely, because the flow velocity of the air is relatively low in that region.

SUMMARY OF THE INVENTION

It is accordingly an object of the invention to provide a hybrid burner for a pre-mixing operation with gas and/or oil, in particular for gas turbine systems, which overcomes the hereinafore-mentioned disadvantages of the heretofore-known devices of this general type and which does so without changing the built-in elements. Optionally, the simultaneous use of gas and oil as fuel should also be possible. In either case, the goal is to reduce the emission of toxic substances, in particular $NO_x$ emissions.

With the foregoing and other objects in view there is provided, in accordance with the invention, a burner for operation with gas and/or oil, comprising a central pilot burner system selectively operable with gas and/or oil as a diffusion burner or as a separate pre-mixing burner, optionally with means for feeding inert substances; and an annular main burner system surrounding the pilot burner system and carrying a primary air flow, the main burner system including a multiplicity of first nozzles admixing gas with the primary air flow for pre-mixing operation, and second inlet nozzles pre-mixing oil into the primary air flow.

In accordance with another feature of the invention, the main burner system includes a swirl vane assembly and the second inlet nozzles for oil are disposed in the vicinity of the swirl vane assembly.

In accordance with a further feature of the invention, the swirl vane assembly has vanes with intermediate spaces therebetween each carrying a flow including a region with highest flow velocity, and the second inlet nozzles are disposed in the vicinity of the region with the highest flow velocity.

In accordance with an added feature of the invention, the second inlet nozzles for oil have an orientation and dimensions providing a maximally fine atomization and uniform distribution in the primary air flow in the normal load range of the burner.

In accordance with an additional feature of the invention, the second inlet nozzles are substantially perpendicular to the flow direction of the primary air flow.

In accordance with yet another feature of the invention, at least one of the inlet nozzles is disposed in each of the intermediate spaces between the vanes of the swirl vane assembly.

In accordance with yet a further feature of the invention, there is provided an annular conduit communicating with the inlet nozzles and substantially concentrically surrounding the pilot burner system, and a primary oil supply line feeding oil to the annular conduit.

In accordance with yet an added feature of the invention, the annular conduit is disposed between the pilot burner system and the main burner system, preferably in the vicinity of a location at which the pilot burner system and the main burner system meet.

In accordance with a concomitant feature of the invention, the main burner system includes a swirl vane assembly with a wall region, the annular conduit overlaps the wall region, and the inlet nozzles are bores formed in the wall region, optionally with nozzle-like screw inserts.

It should be noted that all of the operating methods for a burner configuration of this kind that are known from the prior art are also suitable for the burner according to the invention, and that the invention additionally permits operation with oil. Since the support of a pilot burner system is generally necessary in pre-mixing operation with oil in order to stabilize the flame, once again all of the known types of constructions and various types of operation are also possible for this system. It is particularly advantageous in general to operate both the main burner and the pilot burner with the same fuel, namely gas or oil, but this is not at all absolutely compulsory. In different load ranges, the feeding of inert substances, such as steam, water or nitrogen, can additionally reduce the $NO_x$ emissions in a known fashion. Once again, these provisions are applicable and suitable for the apparatus according to the invention.

Other features which are considered as characteristic for the invention are set forth in the appended claims.

Although the invention is illustrated and described herein as embodied in a hybrid burner for a pre-mixing operation with gas and/or oil, in particular for gas turbine systems, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the drawing.

BRIEF DESCRIPTION OF THE DRAWING

The FIGURE of the drawing is a fragmentary, highly diagrammatic, longitudinal-sectional view of a burner according to the invention.

DESCRIPTION OF THE PREFERRED EMBODIMENT

Referring now to the single FIGURE of the drawing in which non-essential details that have already been described in detail in the prior art are either omitted or simplified for the sake of better comprehension, there is seen a burner according to the invention, which can optionally be used in combination with a plurality of identical burners, such as in the combustion chamber of a gas turbine system. The burner includes an inner part which is the pilot burner system and an outer part which is the primary burner system and is located concentrically to the inner part. Both systems are suitable for operation with gas and/or oil in an arbitrary combination. Natural gas and heating oil are generally used as fuels. The pilot burner system is formed of an inner oil supply conduit 1 carrying a pilot burner oil flow $O_p$ and an inner gas supply conduit 2, disposed concentrically around the oil supply conduit and carrying a pilot burner gas flow $G_p$. The gas supply conduit 2 is in turn surrounded by a concentrically disposed inner air (or inert substance) supply conduit 3 carrying an inert substance flow I and a pilot burner air flow $L_p$. A suitable non-illustrated ignition system which can be disposed in or at the conduit 3, has many possible known constructions. An oil nozzle 5 is disposed at the end of the inner oil supply conduit 1 while a swirl vane assembly 6 is disposed in the end region of the inner air supply conduit 3. The gas from the gas supply conduit 2 enters the region of the swirl vane assembly 6 through openings in the wall of the gas supply conduit 2, as indicated by the arrows 3.2. The pilot burner system 1, 2, 3, 5, 6 can be operated with oil or gas in a known manner. The structure of the pilot burner system as a separate premixing burner, which is known from European Application No. 0 193 838, corresponding to U.S. Pat. No. 4,701,124, is also suitable for the proposed apparatus and does not restrict it.

The main burner system is formed of an outer annular air supply conduit assembly 4, disposed concentrically to and converging obliquely toward the pilot burner system. The annular air supply conduit assembly 4 is also provided with a swirl vane assembly 7. Upstream of the swirl vanes, gas nozzle tubes 10 having a plurality of gas nozzles 11 are located in the flow cross section of the primary air flow $L_H$. These gas nozzles are supplied from an annular gas conduit 9, which has a primary gas supply line 8 carrying a main burner gas flow $G_H$.

In accordance with the invention, a burner additionally has a further annular oil conduit 13, which is supplied from a primary oil supply line 12 carrying a main burner oil flow $O_H$. The annular oil conduit 13 is located concentrically to the pilot burner system 1, 2, 3, 5, 6, specifically in the region in which the pilot burner system meets the main burner system 4, 7. A free space that is already present in previously known constructions can receive the annular oil conduit 13. The annular oil conduit 13 can be formed by means of a single additional partition or wall. The annular oil conduit 13 has bores extending through the wall to the outer annular air supply conduit assembly 4, which terminate in the vicinity of the swirl vanes 7. The bores are provided with nozzles which produce an oil spray stream 15, which is oriented approximately perpendicularly to the primary air flow $L_H$. If the nozzles are disposed in the vicinity of the maximum flow velocity, that is, in the vicinity of the smallest cross section of the swirl vanes, then the primary air flow $L_H$ provides a fine atomization of the injected oil. Preferably, at least one inlet nozzle 14 is disposed in each intermediate space between the vanes of the swirl vane assembly 7. The oil supply can be regulated by the oil pressure in the annular oil conduit 13. The burner outlet is indicated by reference numeral 16.

The burner according to the invention permits flexible adaptation to the type of fuel available in a given instance, while simultaneously minimizing $NO_x$ emissions. In operation with either gas or oil and optionally in combinations of both types of operation, the burner can operate as a pre-mixing burner, and the stability of the flame is assured by means of a pilot burner system.

The foregoing is a description corresponding in substance to German Application P 37 02 181.8, dated Jan. 26, 1987, the International priority of which is being claimed for the instant application, and which is hereby made part of this application. Any material discrepancies between the foregoing specification and the aforementioned corresponding German application are to be resolved in favor of the latter.

What is claimed:

1. Burner for operation with gas and/or oil having a burner outlet, comprising a central pilot burner system operble with gas and/or oil fuel; and an annular main burner system surrounding said pilot burner system and carrying a primary air flow, said main burner system including a multiplicity of first nozzles for admixing gas with the primary air flow for pre-mixing gas and air upstream of the burner outlet, and a plurality of second inlet nozzles for admixing oil into the primary air flow for pre-mixing oil and air upstream of the burner outlet, and said pilot burner system including means for feeding inert substances.

2. Burner for operation with gas and/or oil, comprising a central pilot burner system operable with gas and/or oil fuel; and an annular main burner system surrounding said pilot burner system and carrying a primary air flow, said main burner system including a multiplicity of first nozzles for admixing gas with the primary air flow for pre-mixing gas and air upstream of the burner outlet, a plurality of second inlet nozzles for admixing oil into the primary air flow for pre-mixing oil and air upstream of the burner outlet, and a swirl vane assembly, said second inlet nozzles for oil being disposed in the vicinity of said swirl vane assembly.

3. Burner according to claim 2, wherein said swirl vane assembly has vanes with intermediate spaces therebetween each carrying a flow, said flow including a region with highest flow velocity, and said second inlet nozzles are disposed in the vicinity of said region with said highest flow velocity.

4. Burner according to claim 3, wherein at least one of said inlet nozzles is disposed in each of said intermediate spaces between said vanes of said swirl vane assembly.

5. Burner for operation with gas and/or oil having a burner outlet, comprising a central pilot burner system operable with gas and/or oil fuel; and an annular main burner system surrounding said pilot burner system and carrying a primary air flow in a given direction, said main burner system including a multiplicity of first nozzles for admixing gas with the primary air flow for pre-mixing gas and air upstream of the burner outlet, and a plurality of second inlet nozzles for admixing oil into the primary air flow for pre-mixing oil and air upstream of the burner outlet, said second inlet nozzles for oil being oriented and dimensioned relative to the given direction for providing a maximally fine atomization and uniform distribution in the primary air flow in the normal load range of the burner.

6. Burner according to claim 5, wherein said second inlet nozzles are substantially perpendicular to the flow direction of the primary air flow.

7. Burner for operation with gas and/or oil having a burner outlet, comprising a central pilot burner system operable with gas and/or oil fuel; an annular main burner system surrounding said pilot burner system and carrying a primary air flow, said main burner system including a multiplicity of first nozzles for admixing gas with the primary air flow for pre-mixing gas and air upstream of the burner outlet, and a plurality of second inlet nozzles for admixing oil into the primary air flow for pre-mixing oil and air upstream of the burner outlet; adn annular conduit communicating with said inlet nozzles and substantially concentrically surrounding said pilot burner system, and a primary oil supply line feeding oil to said annular conduit.

8. Burner according to claim 7, wherein said annular conduit is disposed between said pilot burner system and said main burner system.

9. Burner according to claim 7, wherein said pilot burner system and said main burner system meet at a given location, and said annular conduit is disposed in the vicinity of said given location.

10. Burner according to claim 7, wherein said main burner system includes a swirl vane assembly with a wall region, said annular conduit overlaps said wall region, and said inlet nozzles are bores formed in said wall region.

11. Burner according to claim 7, wherein said main burner system includes a swirl vane assembly with a wall region, said annular conduit overlaps said wall region, and said inlet nozzles are bores formed in said wall region with nozzle-like screw inserts.

* * * * *